US008291672B2

(12) United States Patent
Hohmann, Jr. et al.

(10) Patent No.: US 8,291,672 B2
(45) Date of Patent: Oct. 23, 2012

(54) ANCHOR SYSTEM FOR COMPOSITE PANEL

(75) Inventors: Ronald P. Hohmann, Jr., Hauppauge, NY (US); Mark J. Klos, West Mifflin, PA (US)

(73) Assignee: MiTek Holdings, Inc., Wilmington, DE (US)

( * ) Notice: Subject to any disclaimer, the term of this patent is extended or adjusted under 35 U.S.C. 154(b) by 33 days.

(21) Appl. No.: 12/688,636

(22) Filed: Jan. 15, 2010

(65) Prior Publication Data

US 2011/0173902 A1 Jul. 21, 2011

(51) Int. Cl.
*E04B 1/38* (2006.01)
*E04C 5/00* (2006.01)

(52) U.S. Cl. ..... 52/698; 52/410; 52/513; 52/699; 52/710; 52/712; 52/714; 52/715

(58) Field of Classification Search ..... 52/364, 52/379, 410, 513, 698–715
See application file for complete search history.

(56) References Cited

U.S. PATENT DOCUMENTS

| | | | | |
|---|---|---|---|---|
| 3,310,926 | A | 3/1967 | Brandreth et al. | |
| 4,021,990 | A * | 5/1977 | Schwalberg | 52/479 |
| 4,373,314 | A | 2/1983 | Allan | |
| 4,438,611 | A * | 3/1984 | Bryant | 52/309.2 |
| 4,827,684 | A * | 5/1989 | Allan | 52/378 |
| 4,875,319 | A * | 10/1989 | Hohmann | 52/383 |
| 5,207,043 | A * | 5/1993 | McGee et al. | 52/379 |
| 5,671,578 | A * | 9/1997 | Hohmann | 52/562 |
| 5,816,008 | A * | 10/1998 | Hohmann | 52/565 |
| 5,819,486 | A | 10/1998 | Goodings | |
| 6,000,178 | A | 12/1999 | Goodings | |
| 6,332,300 | B1 * | 12/2001 | Wakai | 52/713 |
| 6,351,922 | B1 * | 3/2002 | Burns et al. | 52/713 |
| 6,627,128 | B1 | 9/2003 | Boyer | |
| 6,668,505 | B1 | 12/2003 | Hohmann et al. | |
| 6,789,365 | B1 | 9/2004 | Hohmann et al. | |
| 6,941,717 | B2 * | 9/2005 | Hohmann et al. | 52/506.01 |
| 6,968,659 | B2 | 11/2005 | Boyer | |
| 7,007,433 | B2 | 3/2006 | Boyer | |
| 7,043,884 | B2 | 5/2006 | Moreno | |
| D527,834 | S | 9/2006 | Thimons et al. | |
| D538,948 | S | 3/2007 | Thimons et al. | |
| 7,325,366 | B1 * | 2/2008 | Hohmann et al. | 52/513 |
| 7,748,181 | B1 * | 7/2010 | Guinn | 52/235 |
| 2001/0054270 | A1 * | 12/2001 | Rice | 52/714 |
| 2006/0005490 | A1 | 1/2006 | Hohmann, Jr. | |
| 2008/0092472 | A1 | 4/2008 | Doerr et al. | |

* cited by examiner

*Primary Examiner* — Mark Wendell
(74) *Attorney, Agent, or Firm* — Senniger Powers LLP

(57) ABSTRACT

Anchoring systems for use in cavity wall structures having an inner wythe constructed of interengaged composite panels and a veneer outer wythe are disclosed. The wall anchor is disposed within the juncture of the interengaged composite panels and fastened to the frame. The wall anchor maintains a strong interlock with the composite panels and backup wall, maintains insulation integrity and limits thermal transfer, without obstructing the juncture of the composite panels. The anchoring system interlocks with varied veneer ties, allowing vertical and horizontal adjustment for alignment with the bed joints. The anchoring system for composite panels provides an economical, high strength, low weight, insulated backup wall construction for interengagement with a veneer outer wythe.

14 Claims, 7 Drawing Sheets

ANCHOR SYSTEM FOR COMPOSITE PANEL

BACKGROUND OF THE INVENTION

1. Field of the Invention

This invention relates to an anchoring system for cavity walls having an inner wythe of architectural panels. More particularly, the invention relates to a composite panel backup wall with a brick veneer.

2. Description of the Prior Art

Cavity wall construction backup walls take many forms, including dry wall, concrete masonry units, tilt-up poured concrete, and insulating concrete forms. Selection of the backup wall type is dependent upon location, type and size of construction and other varied considerations. Anchors specific to each type of backup wall construction are inserted into the backup wall to properly anchor the outer wythe or veneer in accordance with the building specifications and location.

In the past, different building specifications and locations resulted in various structural problems such thermal transfer from the inner to the outer wythe, pinpoint loading, high lateral forces related to high-wind and seismic forces and cavity wall insulation deterioration. Ronald P. Hohmann, Jr. and Ronald P. Hohmann of Hohmann and Barnard, Inc., Hauppauge, N.Y., 11788, have solved these varied technical problems relating to differing backup wall technologies. Hohmann's inventions have been in response to changes in Uniform Building Code provisions and to investigations into the effects of various forces upon veneer construction. Exemplary patents include a snap-in wire tie for use in a seismic construction system for a cavity wall (U.S. Pat. No. 7,325,366); a self-sealing wall anchor for maintaining insulation integrity (U.S. Pat. No. 6,941,717); low-profile side-welded anchors and reinforcement devices for cavity walls (U.S. Pat. No. 6,789,365); and high-span and high-strength anchors and reinforcement devices for cavity walls (U.S. Pat. No. 6,668,505).

Another obstacle in cavity wall construction is compliance with the greater insulation requirements set forth in the Massachusetts Energy Code, the Energy Code Requirement, Chapter 13 (78 CMR, Seventh Edition; Boston, Mass.). This Code set forth a required higher R-value insulation perforce and increased the cavity size. To address the Energy Code Requirements, each type of backup wall typically requires a large cavity to house insulation between the backup wall and the veneer. The larger cavities, with the associated thicker insulation, require stronger anchors with concomitantly higher costs. The present invention solves the construction issues relating to thermal transfer, pinpoint loading, high lateral forces and maintaining high R-value insulation integrity, through the novel use of an insulated composite panel anchoring system.

Architectural or composite panels date back many years and, as shown in F. B. Brandreth, et al. U.S. Pat. No. 3,310,926, form various types of enclosures. Brandreth describes sandwich-type panel construction with face sheets formed from metal or plastic. The interior of each panel can be filled with insulating material. Brandreth further describes associated frame members, mullions and sills.

Panels evolved through the years to become sturdier, more insulative and have reached a technology level that includes the thin composite wall panels detailed in Boyer, U.S. Pat. No. 7,007,433, assigned to Centria of Moon Township, Pa. Centria has numerous patents relating to the design and construction of panels and wall systems of interconnecting panels. Exemplary panels thereof are described in U.S. Pat. Nos. 6,968,659, 6,627,128, D538,948 and D527,834. Composite panels are generally composed of metal sheet elements or laminates that are integratible with one another to create an interior space for an insulative core of foam or polymer. As shown in Boyer, U.S. Pat. No. 6,968,659, structures utilizing composite panels are constructed using composite joinery. The resulting building is sturdy and insulative, but not as aesthetically pleasing as brick veneer. The present invention is designed to work in conjunction with the innovative Centria composite panels and wall systems of interconnecting panels.

Composite panels take many forms including aluminum plate, thin composite panels consisting of two thin aluminum sheets sandwiching a thin plastic interlayer, metal sheets bonded to rigid insulation to create a sandwich panel, fiber-reinforced plastic, stainless steel and terracotta. The impermeable exteriors of the panel ensure that the built in insulation maintains the R-value during the life of the building, thereby lowering heating and cooling costs. Composite panels are lightweight, weighing as little as 1.6 P.S.F., but structurally strong enough to cover long spans.

In the past, although composite panels would provide an efficient back-up wall for commercial brick veneer construction, the lack of a proper anchoring system restricted this practice. The present invention solves the anchoring problem related to the use of composite panels as the inner wythe by providing an anchoring system integral with the composite panel construction.

In preparing for this application the following patents and patent applications came to the attention of the inventors and are believed to be relevant to the further discussion of the prior art:

| U.S. Pat. No. | Inventor | Issue Date |
|---|---|---|
| 5,819,486 | Goodings | Oct. 13, 1998 |
| 6,000,178 | Goodings | Dec. 14, 1999 |
| 7,043,884 | Moreno | May 16, 2006 |

| Patent Application Publication No. | Inventor | Publication Date |
|---|---|---|
| US 2008/0092472 | Doerr et al. | Apr. 24, 2008 |

U.S. Pat. No. 5,819,486—Goodins—Issued Oct. 13, 1998 discloses an anchor for use in the installation of a composite building panel. The anchor comprises a wall mounting face, a spacer and two flange receiving grooves. The anchor is mounted to the backup wall with a fastener.

U.S. Pat. No. 6,000,178—Goodins—Issued Dec. 14, 1999 describes an apparatus for use in the installation of a composite building panel. The apparatus comprises a corrugated member adhered to the panel to form a back face which locks with the anchor of an adjacent panel.

U.S. Pat. No. 7,043,884—4,021,990—Moreno—Issued May 16, 2006 discloses a cladding system for mounting stone cladding panels on an exterior of a building to form a facade. The panels are mounted on rails which are, in turn, mounted upon vertical mullions which have associated structural anchors.

U.S. Patent Publication No. US 2008/0092472—Doerr et al.—Published Apr. 24, 2008 discloses an anchor assembly for use in joining a masonry structure with a backup wall formed from insulated concrete form blocks. The anchor assembly includes an anchor and a tie.

None of the above references provide the advancements in anchoring systems and commercial construction as detailed herein. The present novel invention offers a multi-purpose solution by resolving issues relating to thermal transfer, pinpoint loading and high lateral forces, while maintaining insulation integrity. By providing an anchoring system for use with a composite panel backup wall, safety requirements are met and training and construction costs are reduced.

The present invention provides an all-in-one composite panel backup solution by combining the benefits of composite panels, cavity walls and brick veneer through the use of a novel anchoring system. The resulting combination controls moisture penetration, improves thermal performance and reduces enclosure time. The single component insulated composite back-up wall panel system eliminates batt insulation, wide cavity spans, exterior gypsum board and building wraps, while enhancing thermal efficiency and moisture control. The one piece construction is lightweight and meets the Massachusetts Energy code. The metal skins provide a superior water drain plain, air barrier and vapor barrier. The one piece anchoring system allows for rapid completion of the construction of the backup wall.

The anchoring system provides a structurally strong connection between the veneer and the frame, meeting or exceeding code requirements. The present anchoring system resolves past problems relating to thermal transfer, pinpoint loading, high lateral forces and insulation integrity while simultaneously reducing installation labor and energy costs, thereby saving time and money. The anchoring system fits within the junction of adjacent composite panels. The insertion end of the anchor is pronged and inserted into the insulative core of the composite panel at a break in the panel skin or alternatively shaped for complete securement within the adjacent composite panels. The anchoring system is angled to facilitate drainage and is designed to secure any necessary flashing to the inner wythe.

None of the prior art provides an all-in-one backup solution using composite panels. As will become clear in reviewing the disclosure which follows, the insulated cavity wall structure benefits from the recent developments described herein that leads to solving the problems of constructing a commercial structure efficiently, from both an insulative as well as a cost/time perspective.

SUMMARY

In general terms, the anchoring systems for composite panel systems disclosed hereby are an integral part of the construction of a cavity wall having a veneer outer wythe and an inner wythe or backup wall formed from interengaged composite panels mounted on a frame. A juncture is formed at the location of the interengagement of the composite panels. A novel veneer anchor is fastened to the frame, using a thermally isolating fastening means, and set within the composite panel juncture without obstructing the juncture or panel drains. The wall anchor is a high strength metal stamping.

A veneer tie is interengaged with the anchoring system and set within the bed joints of the outer wythe. A reinforcement wire is interconnected with the veneer tie and disposed in the bed joint thereby providing a high degree of seismic protection. The veneer tie is either interengaged directly with the wall anchor or connected to the wall anchor through the use of a connection bar. The connection bar is capable of connection with a plurality of adjustable veneer ties that are aligned with the bed joints.

The present anchoring system for composite panels has varied applications and provides a universal solution. One such application is for interengagement with Centria's composite panel system. Centria's panel systems provide a high strength, low weight, insulated backup wall. The panels are interconnected using a tongue and groove system located at the connection of the inner and outer facing sheets. The wall anchor fits within the juncture of adjacent panels, maintaining the strong interlock of the panels, without obstructing the juncture or the drainage system. A first embodiment anchor is pronged and inserted directly into the composite panel to minimally disrupt the insulative properties of the panel core while further securing the wall anchor to the backup wall and providing a gauge for positioning the anchor. The A second embodiment anchor is contoured to completely fit within the composite panel juncture. Sealant is applied within the juncture to provide further protection against water and water vapor.

OBJECTS AND FEATURES OF THE INVENTION

It is an object of the present invention to provide new and novel anchoring systems for cavity wall construction, which systems are utilizable with a composite panel backup wall.

It is another object of the present invention to provide an all-in-one cavity wall solution using composite panels with integral brick anchors.

It is yet another object of the present invention to provide an anchoring system that includes a wall anchor for securing the composite panels to the studs and to one another and a veneer anchor.

It is still yet another object of the present invention to provide an anchoring system for composite panel backup walls, which walls contain an integral air and vapor barrier and rigid insulation.

It is another object of the present invention that the composite panels provide a water drain for the removal of water and moisture from the wall cavity.

It is a feature of the present invention that the composite panel backup wall eliminates the need for batt insulation, exterior gypsum board, and building wraps.

It is another feature of the present invention that the veneer anchor is attached to the fastener that secures the composite panels to the studs.

It is yet another feature of the present invention that the integral veneer anchors are labor-saving and reduce costs.

Other objects and features of the invention will become apparent upon review of the drawing and the detailed description which follows.

BRIEF DESCRIPTION OF THE DRAWINGS

In the following drawing, the same parts in the various views are afforded the same reference designators.

DESCRIPTION OF THE PREFERRED EMBODIMENTS

The anchoring system hereof provides devices to adapt panel wall systems, including Centria's wall system, described hereinabove, for usage in a cavity wall as the inner wythe or backup wall. The anchoring system hereof maintains and enhances the connectivity of the architectural composite panels to the frame, while minimizing thermal transfer to and from the cavity thereby maintaining the insulation integrity. The wall anchors of the anchoring system work with the panel end geometry to maintain the strong interlock arrangement of the panels.

The anchoring system for composite panels described herein addresses issues unique to the art of anchoring masonry veneers in an efficient and insulatively compliant manner. Unlike any other structure-supporting building materials, wall anchors are relatively small, isolated assemblies that operate individually and in concert to shoulder the burden of severe forces bearing upon massive solid-wall constructs. The construction of brick veneer cavity wall structures face many challenges. Proper insulation, cavity drainage and moisture removal, thermal transfer, pinpoint loading and stability are examples of the challenging areas. The development of an anchoring system for composite panels is in response to these challenges. This invention resolves the structural issues related to the construction of a high-span cavity between the inner and outer wythe, by internalizing and securing the necessary insulation within the composite panel inner wythe. This invention further reduces other costs and elements required to construct a cavity wall system.

This anchoring system, discussed in detail hereinbelow, consists of a composite panel system with an integrated veneer anchor that is disposed within the juncture of adjacent composite panels. The anchor is constructed to fit within the juncture without obstructing the gutter drainage means or the interlocking of the composite panels. The anchor also serves to connect the veneer to the frame. The veneer anchor is mounted vertically or horizontally and works in conjunction with several veneer ties including, but not limited to, ones having pintle connectors and box or Byna ties. As the veneer being anchored is a brick veneer, the anchoring system includes sufficient vertical adjustment so as to avoid any misalignment.

Figure 1:
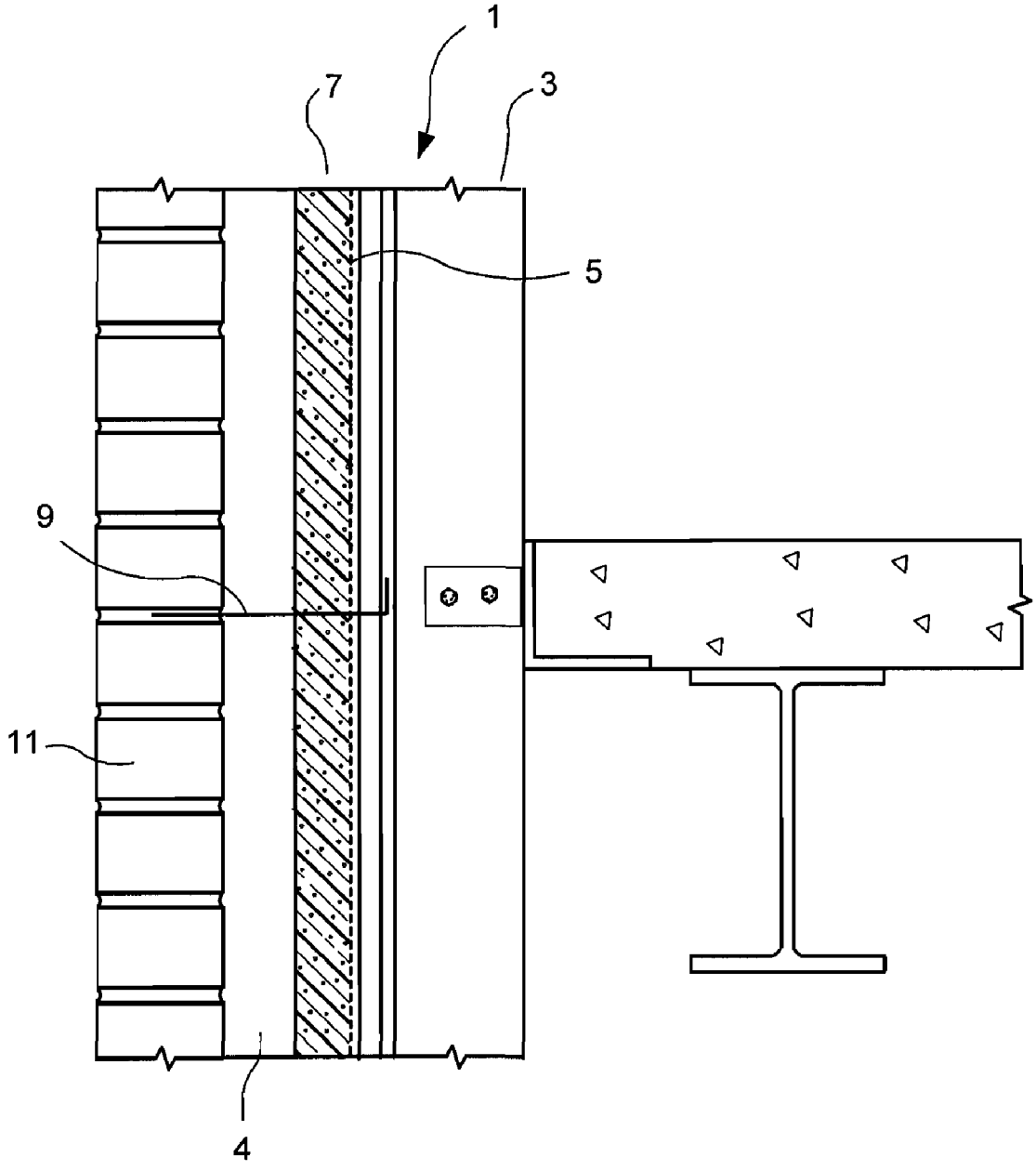
F I G. 1 PRIOR ART
FIG. 1 shows a prior art cavity wall construction and is a cross-sectional view of the prior art anchoring system.

The present invention is in response to the prior art labor and materials intensive cavity wall construction. Construction of a cavity wall containing an inner backup wall or wythe and a masonry outer wythe involves numerous components, which in turn require numerous suppliers and subcontractors adding to the time and cost of construction. An example of a prior art cavity wall structure is shown in FIG. 1. The prior art cavity wall structure 1 requires an inner wythe 3 of dry wall, masonry wall units, tilt-up concrete panels or other suitable building materials. The inner wythe 3 is then protected with a building wrap or flashing 5 which assists water and moisture removal and often terminates with a drip edge (not shown). Once the inner wythe 3 is protected against water and moisture, insulation 7 is then mounted on the exterior of the inner wythe 3 so as to meet the building code requirements. A specialized anchoring system 9 secures the outer wythe 11 to the inner wythe 3. This cumbersome process requires skilled craftsmen to ensure that each step is undertaken carefully and with appropriate care. Several problems such as thermal transfer, insulation deterioration, pinpoint loading and failures due to high lateral forces are present in the prior art. The present invention streamlines the prior art process and resolves such problems through the use of an anchoring system for composite panels.

Referring now to FIGS. 2 through 5, the first embodiment of the present invention shows the anchoring system for composite panels with a brick veneer outer wythe. The anchoring system for composite panels is referred to generally by the numeral 10. A cavity wall structure 12 is shown having an inner wythe or composite panel backup wall 14 supported on a structural framework or frame, including metal studs or vertical columns 16. The inner wythe 14 is assembled from interengaged individual panels 17 having adjacent panel ends 19, 21 forming a vertical juncture 23 and being connected along the lower and upper side edges 25, 26 to form a horizontal wall joint 28. The cavity wall 12 also includes an outer wythe or facing 18 of brick 20 construction. Between the inner wythe 14 and the outer wythe 18, a cavity 22 is formed.

Successive bed joints 30 and 32 are substantially planar and horizontally disposed and, in accord with building standards, are 0.375-inch (approx.) in height. Selective ones of bed joints 30 and 32, which are formed between courses of bricks 20, are constructed to receive therewithin the insertion portion of the veneer tie of the anchoring system hereof.

For purposes of discussion, the cavity surface 24 of the inner wythe 14 contains a horizontal line or x-axis 34 and an intersecting vertical line or y-axis 36. A horizontal line or z-axis 38, normal to the xy-plane, passes through the coordinate origin formed by the intersecting x- and y-axes.

The composite panel 14 is typically between 12 and 20 feet long, approximately 24 to 36 inches wide, and comprises inner and outer facing sheets 29, 31 and a structural insulative core 39 of foam filling the interior space of the building panel 14 and adhesively connecting the facings sheets 29, 31 to provide a structural panel. The inner and outer facing sheets 29, 31 contain a break 15 to allow a direct opening to the insulative core 39 for insertion of the panel-housed portion 35. Although the use of a foam is discussed herein, it is to be understood that this represents only one type of core material that are utilized in a composite building panel. Examples of other types of core material that are substituted for the foam core include polymeric materials and a conventional honeycomb core structure.

At the upper edge 26 of the composite panel 14, the inner and outer facings sheets 29, 31 provide a tongue 37 at the lower edge 25 of the panel 14, the inner and outer facing sheets 29, 31 provide a connector groove 41 adapted to receive the tongue 37 of a subjacent building panel. The connector groove 41 receives a bead of sealant 45, such as a non-hardening butyl sealant. The bead of sealant 45 is adapted to be penetrated by the tongue 37 of a subjacent panel to form a seal.

Gutter means 57 are provided at the upper edge 26 of the building panel 14. The gutter means extends substantially entirely along the full length of the building panel 14. The gutter means serves to eliminate water and moisture bypassing the outer joint of a subjacent building panel.

The wall anchor 40 is shown as a contoured structure which is mounted between adjacent composite panels. The wall anchor is a metal stamping constructed from galvanized steel, hot dipped galvanized steel, stainless steel or bright basic steel. The wall anchor 40 is also mountable between horizontally adjacent composite panels (not shown). The wall anchor has a base portion 33, an panel-housed portion 35 and a free end portion 42 with at least one receptor portion 66. The base portion 33 is substantially planar and fastened to the frame 16. The panel-housed portion 35 of the wall anchor 40 is prong shaped 51 to minimally disrupt the insulative properties of the core during insertion while greatly increasing the strength of the connection between the inner 14 and outer wythe 18 and providing a gauge for positioning the receptor portion 66. Because the insertion portion 35 is prong shaped, the wall anchor 40 only abuts the outer facing sheet 31 at the prong endpoints, thereby minimizing thermal conductivity. The anchor free end portion 42 extends through the seam 28 created at the junction of the adjacent composite panels. Upon installation, the free end portion 42 is disposed in the cavity 22 for interconnection with the veneer tie 44 through receptor portion 66. The free end portion 42 and the panel-housed portion 35 are bent 53, 63, respectively, to facilitate drainage in the cavity 22.

The wall anchor 40 fits within the junction of the adjacent composite panels and is fastened to the column 16. The anchor 40 is fastened to the column 16 with a fastener 46 thereby creating a high-strength connection with the anchor 40 and the frame 16. Although other fastening means are compatible, the fastener 46 is typically a bolt with a head with a washer mounted under the bolt head. A thermal break is maintained through the use of a neoprene washer (not shown) between the fastener 46 and the composite panel 14 and the minimal contact of the insertion portion 35. When a gypsum board with a membranous vapor permeable water barrier is part of the backup wall, an optional continuous shim (not shown), for protecting the dimensional stability of the membrane may be inserted adjacent the column.

Figure 2:
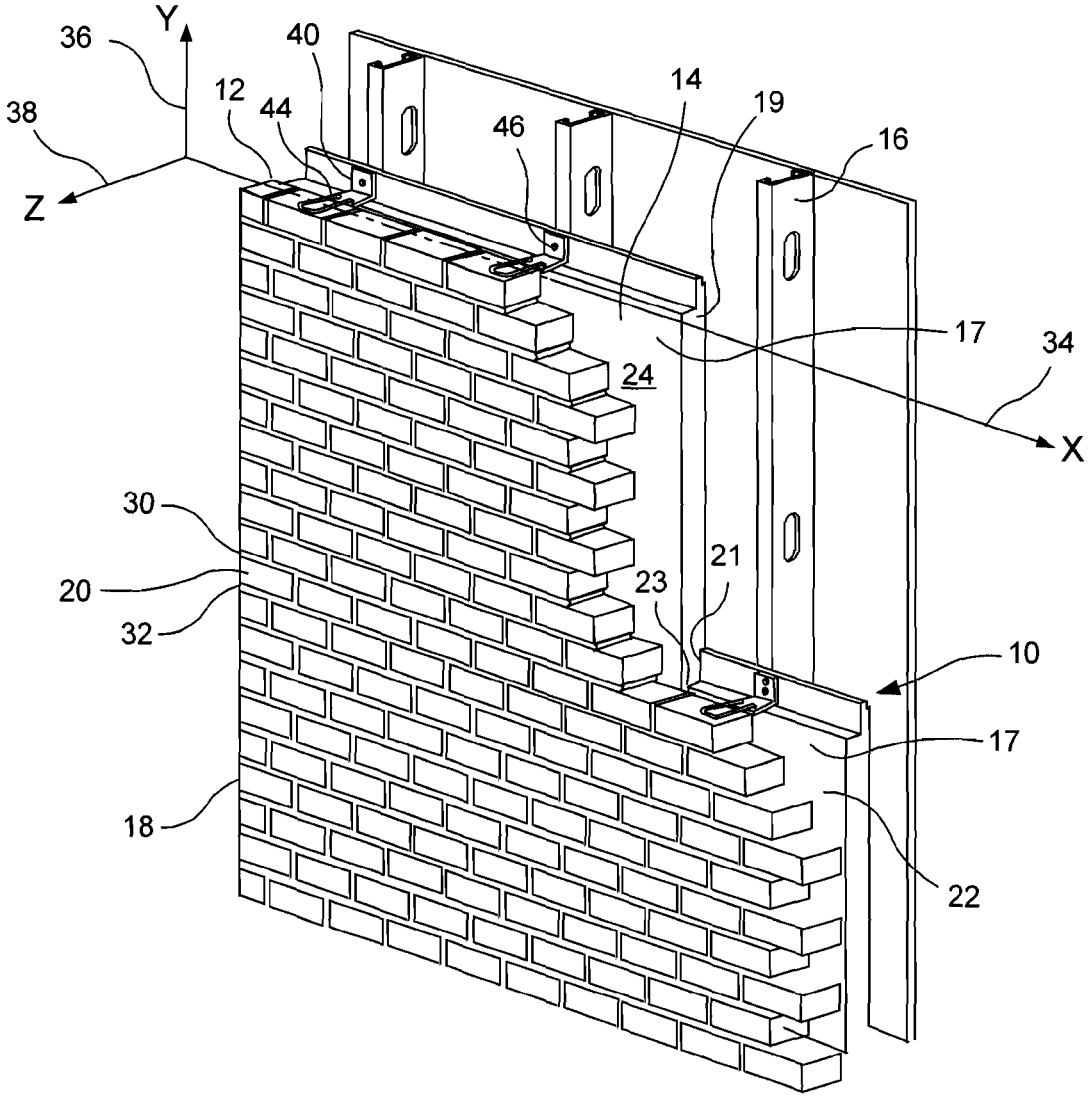
FIG. 2 shows a first embodiment of the composite panel anchoring system of this invention and is a perspective view of the anchoring system partially constructed, mounted on the columns and with an attached brick veneer.
Figure 4:
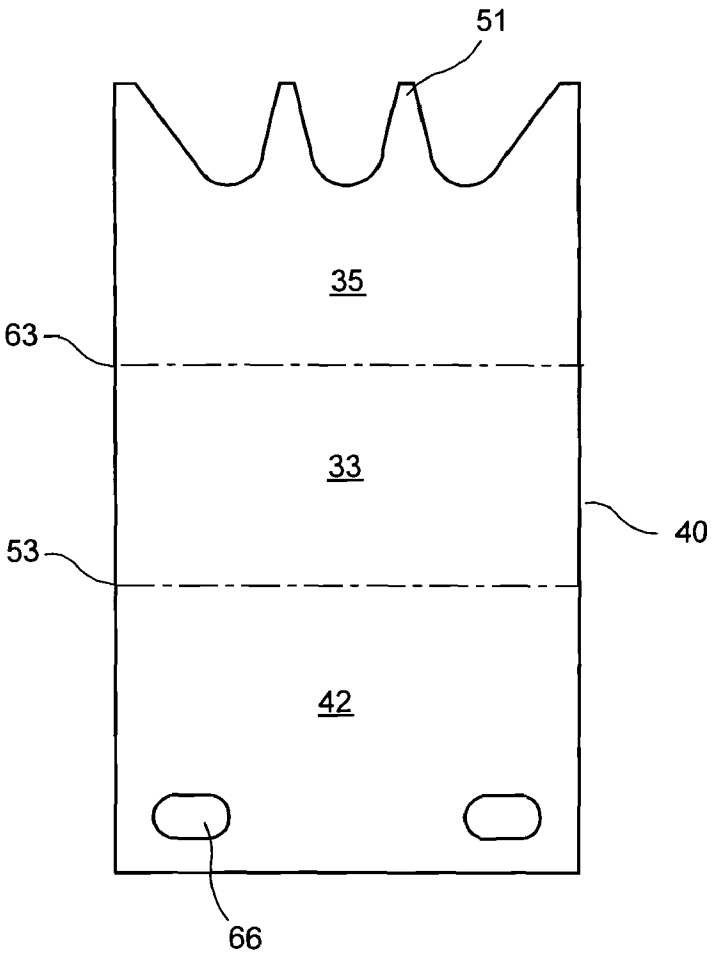
FIG. 4. is a top plan view of the anchor of FIG. 2 detailing the pronged end of the anchor.
Figure 3:
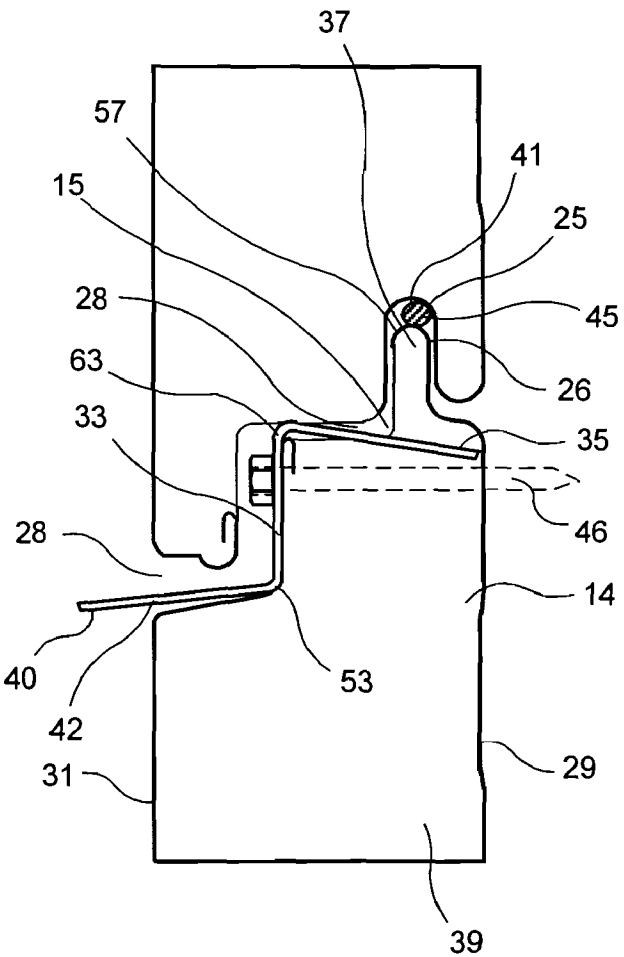
FIG. 3 is a cross sectional view of FIG. 2 showing a fully constructed composite panel anchoring system.

The system includes the wall anchor 40 and a veneer tie 44. Although various veneer ties work in conjunction with the wall anchor 40, including the use of a connection bar and apertured veneer ties (not shown) or a box or Byna-Tie threadedly mounted through the free end aperture (not shown), the veneer tie 44 shown is a wire formative pintle device manufactured by Hohman & Barnard, Inc., Hauppauge, N.Y. 11788. The veneer tie 44, is shown in FIG. 2 as being emplaced on the course of bricks 20 in preparation for embedment in the mortar of the bed joint 30. The veneer tie 44 is fixedly disposed in an x-z plane of the bed joint 30 and is constructed to adjustably position with the longitudinal axis substantially horizontal and to interengage with the wall anchor 40. The veneer tie 44 has an interengaging end 65 for disposition in said free end receptor portion 66 and an insertion end 67 adapted for embedment in the bed joint 30. The free end receptor portion 66 is not limited as shown but may take any number of forms that correspond with a matching veneer tie 44. The veneer tie 44 is constructed of front leg portions 54 adapted for insertion into said bed joint 30, side leg portions 55 coextensive, perpendicular, and substantially co-planar with the front leg portions 54 and a pair of pintle portions 59, 61 coextensive with the side leg portions 55 and disposed for insertion through the free end aperture 66. The veneer tie is vertically adjustable to a substantially horizontal position and upon installation, maintains continuous positive interengagement with the wall anchor 40. For additional seismic and high-wind protection, a reinforcement wire (not shown) is embedded in the bed joint 30 and set within an optionally swaged front leg portion 54 for a snap-in connection.

The wall anchors 40 are positioned so that the intervals therebetween coincide with the junction of the adjacent composite panels. The panel-housed portion 35 is proportioned to fit between adjacent composite panels and does not occlude receptor portion 66. This construct maintains the structural integrity of the system.

Figure 6:
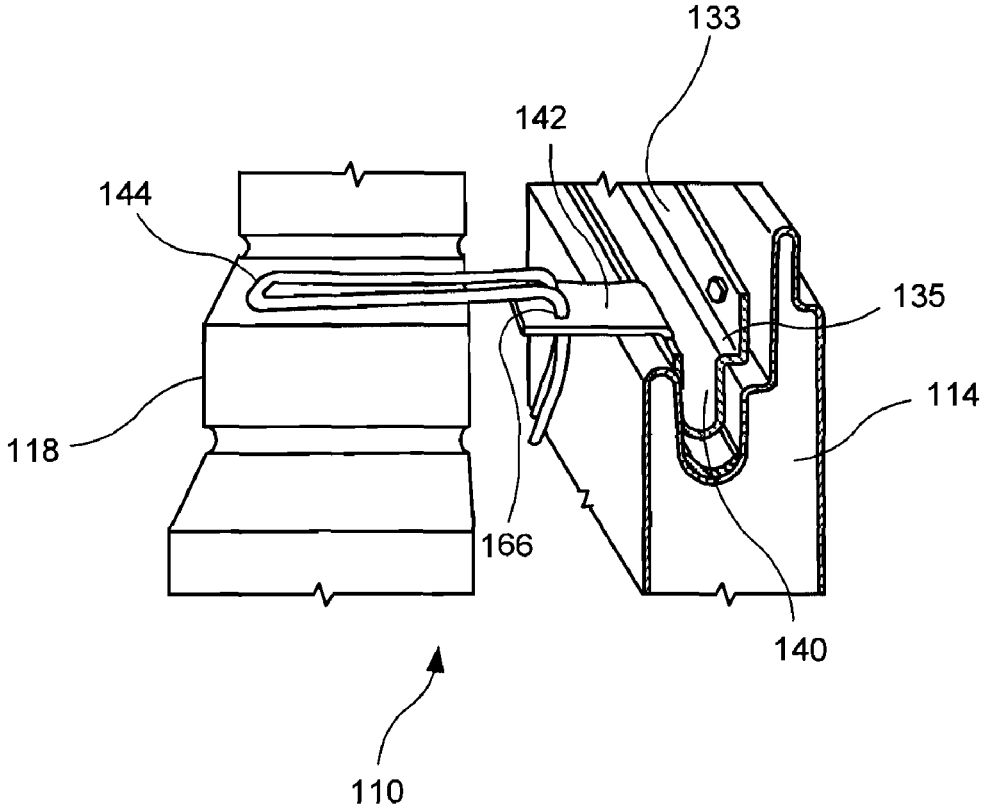
FIG. 6 shows a second embodiment of the composite panel anchoring system of this invention and is a cross sectional view showing the relationship of the composite panel anchoring system to the brick veneer.
Figure 8:
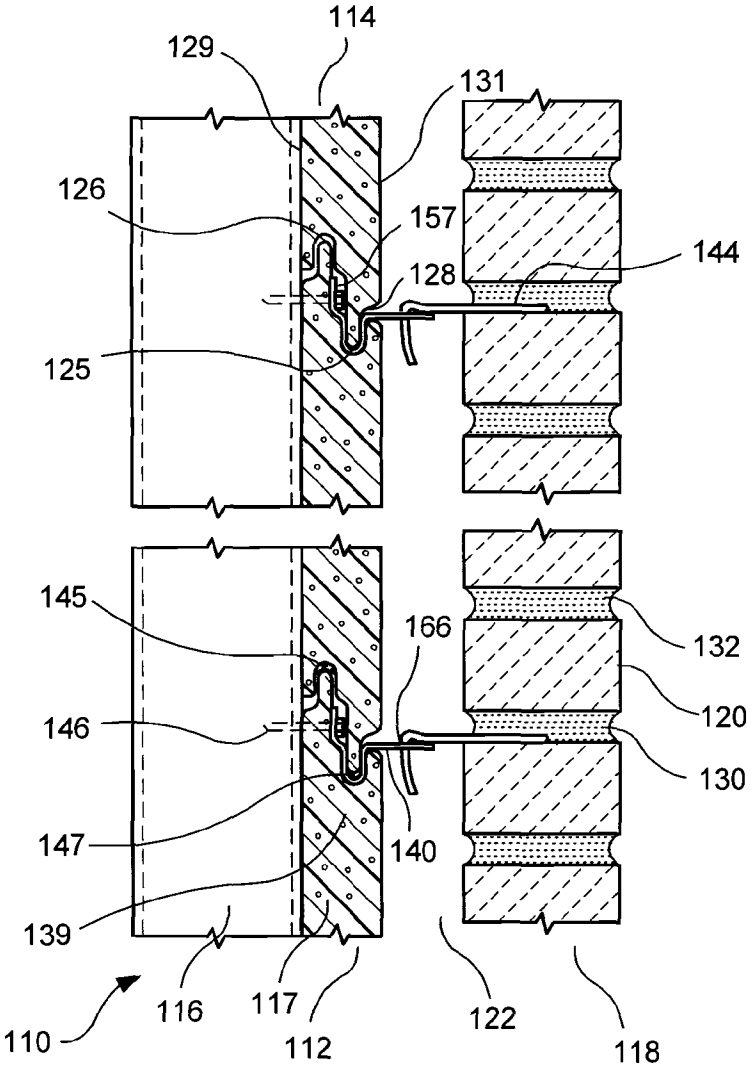
FIG. 8 is a cross sectional view of the second embodiment showing successive courses of a fully constructed composite panel anchoring system with a veneer tie threaded through the veneer anchor and mounted on a course of bricks.
Figure 7:
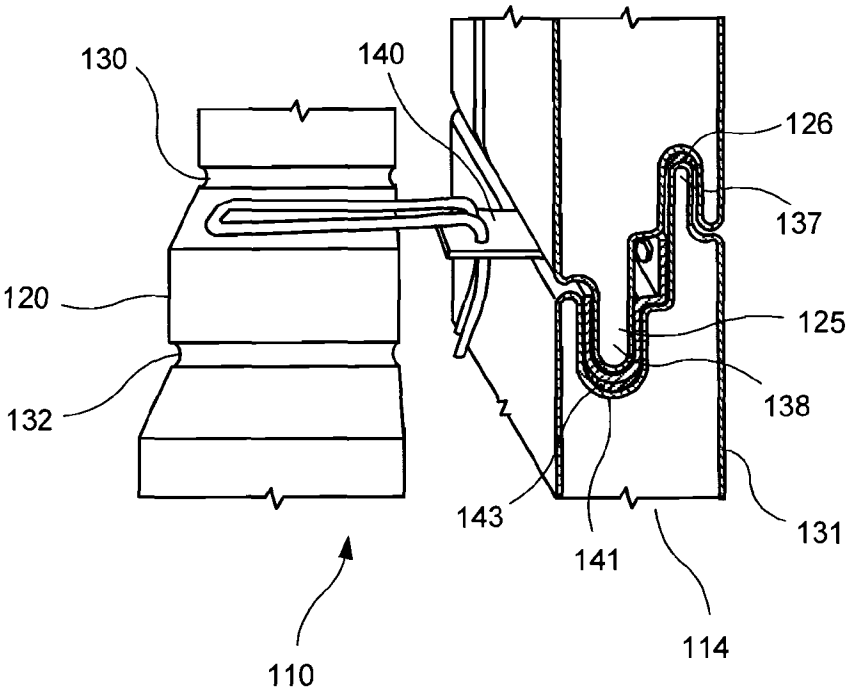
FIG. 7 is a cross sectional view of the second embodiment showing a fully constructed composite panel anchoring system with a veneer tie threaded through the veneer anchor and mounted on a course of bricks.

The description which follows is a second embodiment of the surface-mounted anchoring system for cavity walls of this invention. For ease of comprehension, wherever possible, similar parts use reference designators 100 units higher than those above. Thus, the backup wall 114 of the second embodiment is analogous to the backup wall 14 of the first embodiment. As in the first embodiment, shown in FIG. 1, a cavity wall structure is formed. Referring now to FIGS. 6 through 8, the second embodiment of the present invention shows the anchoring system for composite panels with a brick veneer outer wythe. The anchoring system for composite panels is referred to generally by the numeral 110. A cavity wall structure 112 is shown having an inner wythe or composite panel backup wall 114 supported on a structural framework or frame, including metal studs or vertical columns 116. The inner wythe 114 is assembled from interengaged individual panels 117 having adjacent panel ends that form a vertical juncture (not shown) and being connected along the lower and upper edges 125, 126 to form a horizontal wall joint 128. The cavity wall 112 also includes an outer wythe or facing 118 of brick 120 construction. Between the inner wythe 114 and the outer wythe 118, a cavity 122 is formed.

Successive bed joints 130 and 132 are substantially planar and horizontally disposed and, in accord with building standards, are 0.375-inch (approx.) in height. Selective ones of bed joints 130 and 132, which are formed between courses of bricks 120, are constructed to receive therewithin the insertion portion of the veneer tie of the anchoring system hereof.

The composite panel 114 is typically between 12 and 20 feet long and approximately 24 to 36 inches wide and comprises inner and outer facing sheets 129, 131 and a structural insulative core 139 of foam filling the interior space of the building panel 114 and adhesively connecting the facings sheets 129, 131 to provide a structural panel. Although the use of a foam is discussed herein, it is to be understood that this represents only one type of core material that are utilized in a composite building panel. Examples of other types of core material that are substituted for the foam core include polymeric materials and a conventional honeycomb core structure.

At the upper edge 126 of the composite panel 114, the inner and outer facings sheets 129, 131 provide inner and outer connectors or tongues 137, 138, at the lower edge 125 of the panel 114, the inner and outer facing sheets 129, 131 provide inner and outer connectors or grooves 141, 143 adapted to receive the tongues 137, 138 of a subjacent building panel. The inner and outer connectors grooves 141, 143 each receive a bead 145, 147 of sealant, such as a non-hardening butyl sealant. The beads 145, 147 of sealant are adapted to be penetrated by the tongues 137, 138 of a subjacent panel to form inner and outer seals.

Gutter means 157 are provided at the upper edge 126 of the building panel 114 and intermediate of the inner and outer tongues 137, 138. The gutter means extends substantially entirely along the full length of the building panel 114. The gutter means serves to eliminate water and moisture bypassing the outer joint formed between the groove 141 and the tongue of 137 of a subjacent building panels.

The wall anchor 140 is shown as a contoured structure which is mounted between adjacent composite panels. The wall anchor is a metal stamping constructed from galvanized steel, hot dipped galvanized steel, stainless steel or bright basic steel. The wall anchor 140 is also mountable between horizontally adjacent composite panels (not shown). The wall anchor has a base portion 133, a contoured portion 135 and a free end portion 142 with a receptor portion 166. The base portion 133 is substantially planar and fastened to the frame 116. The contoured portion 135 of the wall anchor 140 is shaped to mirror the composite panel tongue and grooves 137, 139, 141 and 143 and to fit within the juncture 128 without obstructing the interengagement of the composite panels or the gutter means 157. The anchor free end portion 142 extends through the seam 128 created at the junction of the adjacent composite panels. Upon installation, the free end portion 142 is disposed in the cavity 122 for interconnection with the veneer tie 144 through a receptor portion 166. The wall anchor 140 fits within the junction of the adjacent composite panels and is fastened to the column 116. The anchor 140 is fastened to the column 116 with a fastener 146 thereby creating a high-strength connection with the anchor 140 and the frame 116. Although other fastening means are compatible, the fastener 146 is typically a bolt with a head with a washer mounted under the bolt head. A thermal break is obtained through the use of a neoprene washer (not shown) between the fastener 146 and the composite panel 114. When a gypsum board with a membranous vapor permeable water barrier is part of the backup wall, an optional continuous shim (not shown), for protecting the dimensional stability of the membrane may be inserted adjacent the column.

The system includes the wall anchor 140 and a veneer tie 144. Although various veneer ties work in conjunction with the wall anchor 140, including the use of a connection bar and apertured veneer ties as described in the second embodiment set forth below (not shown) or a box or Byna-Tie threadedly mounted through the free end aperture (not shown), the veneer tie 144 shown is a wire formative pintle device manufactured by Hohman & Barnard, Inc., Hauppauge, N.Y. 11788. The veneer tie 144, is shown in FIG. 6 as being emplaced on the course of bricks 120 in preparation for embedment in the mortar of the bed joint 130. The veneer tie 144 is fixedly disposed in an x-z plane of the bed joint 130 and is constructed to adjustably position with the longitudinal axis substantially horizontal and to interengage with the wall anchor 140.

Figure 5:
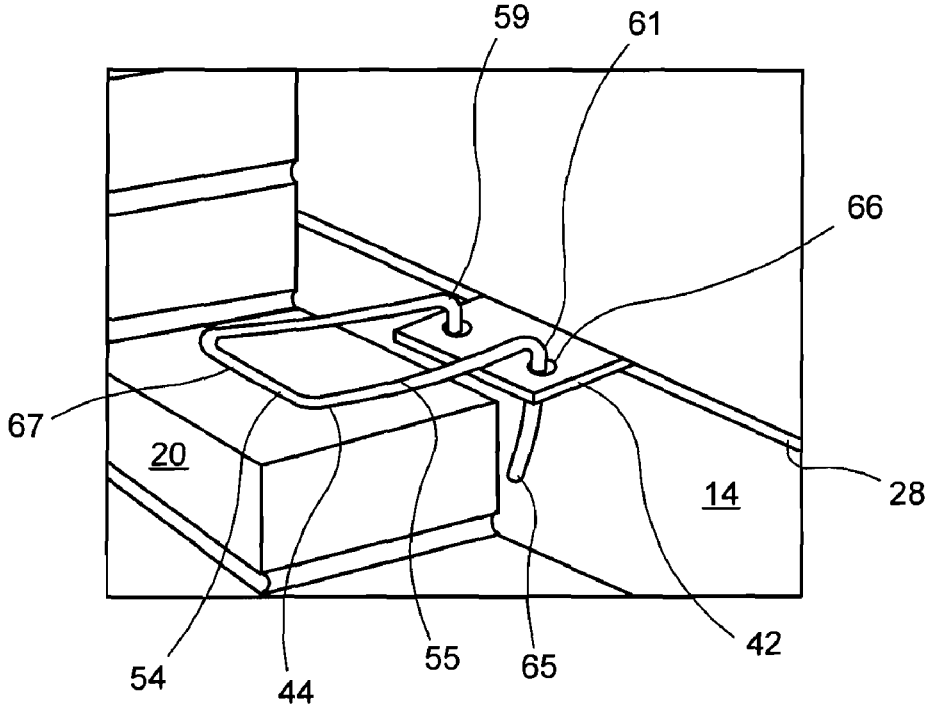
FIG. 5 is a perspective view of a partially-constructed composite wall panel with an attached veneer anchor and veneer tie threaded therethrough and mounted on a course of bricks.

The veneer tie 144 is the same as the veneer tie shown in FIG. 5 and has an interengaging end 65 for disposition in said free end receptor portion 66 and an insertion end 67 adapted for embedment in the bed joint 30. The veneer tie 44 is constructed of front leg portions 54 adapted for insertion into said bed joint 130, side leg portions 55 coextensive, perpendicular, and substantially co-planar with the front leg portions 54 and a pair of pintle portions 59, 61 coextensive with the side leg portions 55 and vertically disposed for insertion through the free end aperture 66. The veneer tie is vertically adjustable to a substantially horizontal position and upon installation, maintains continuous positive interengagement with the wall anchor 140. For additional seismic and high-wind protection, a reinforcement wire (not shown) is embedded in the bed joint 130 and set within an optionally swaged front leg portion 54 for a snap-in connection.

The wall anchors 140 are positioned so that the intervals therebetween coincide with the junction of the adjacent composite panels. The contoured portion 135 is proportioned so that the anchor fits snugly between adjacent composite panels and does not occlude receptor portion 166. This construct maintains the structural integrity of the system.

Figure 9:
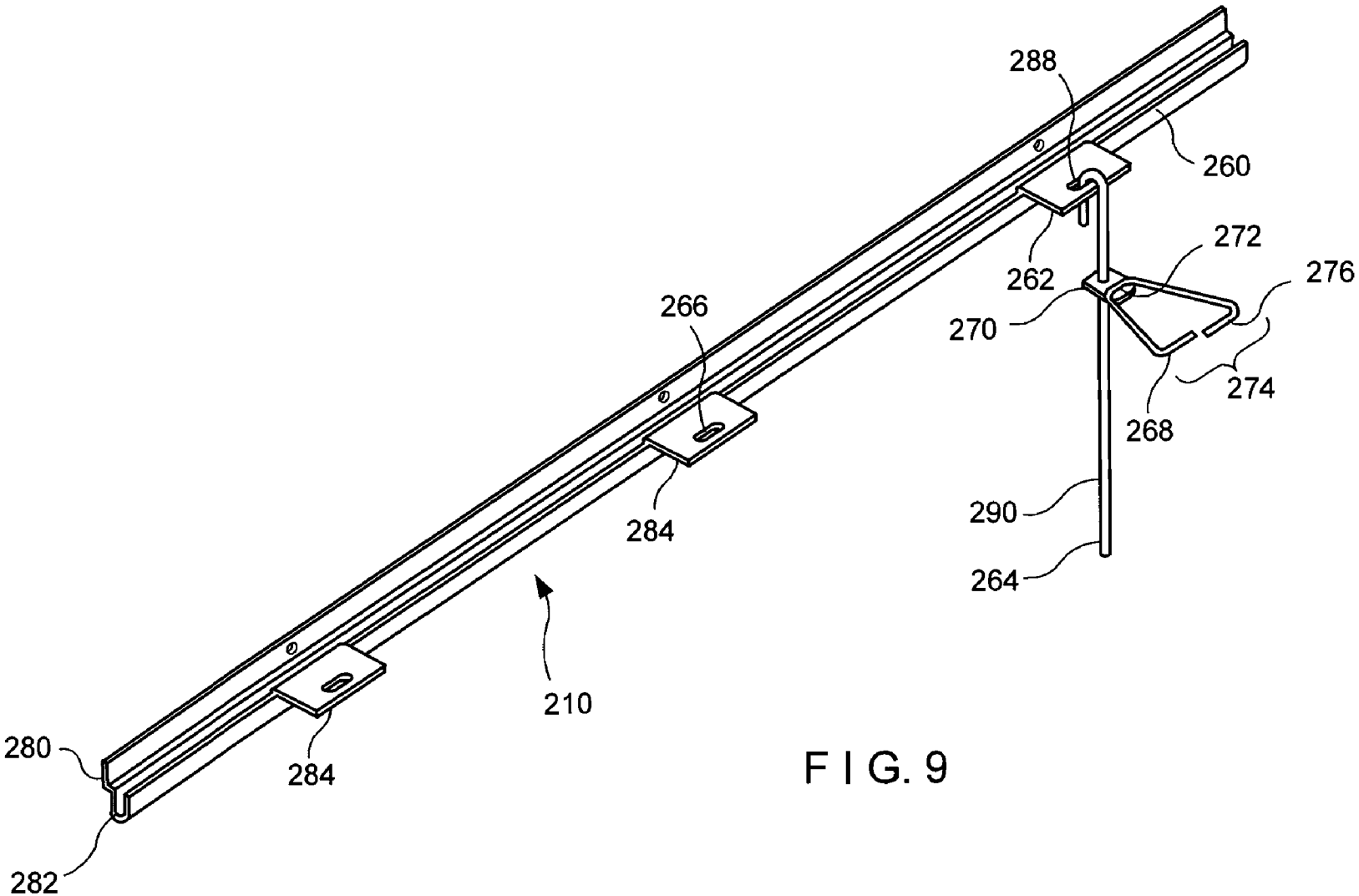
FIG. 9 shows a third embodiment of the composite panel anchoring system of this invention and is a perspective view of the uninstalled veneer anchor with a veneer tie threaded through the veneer anchor.
Figure 10:
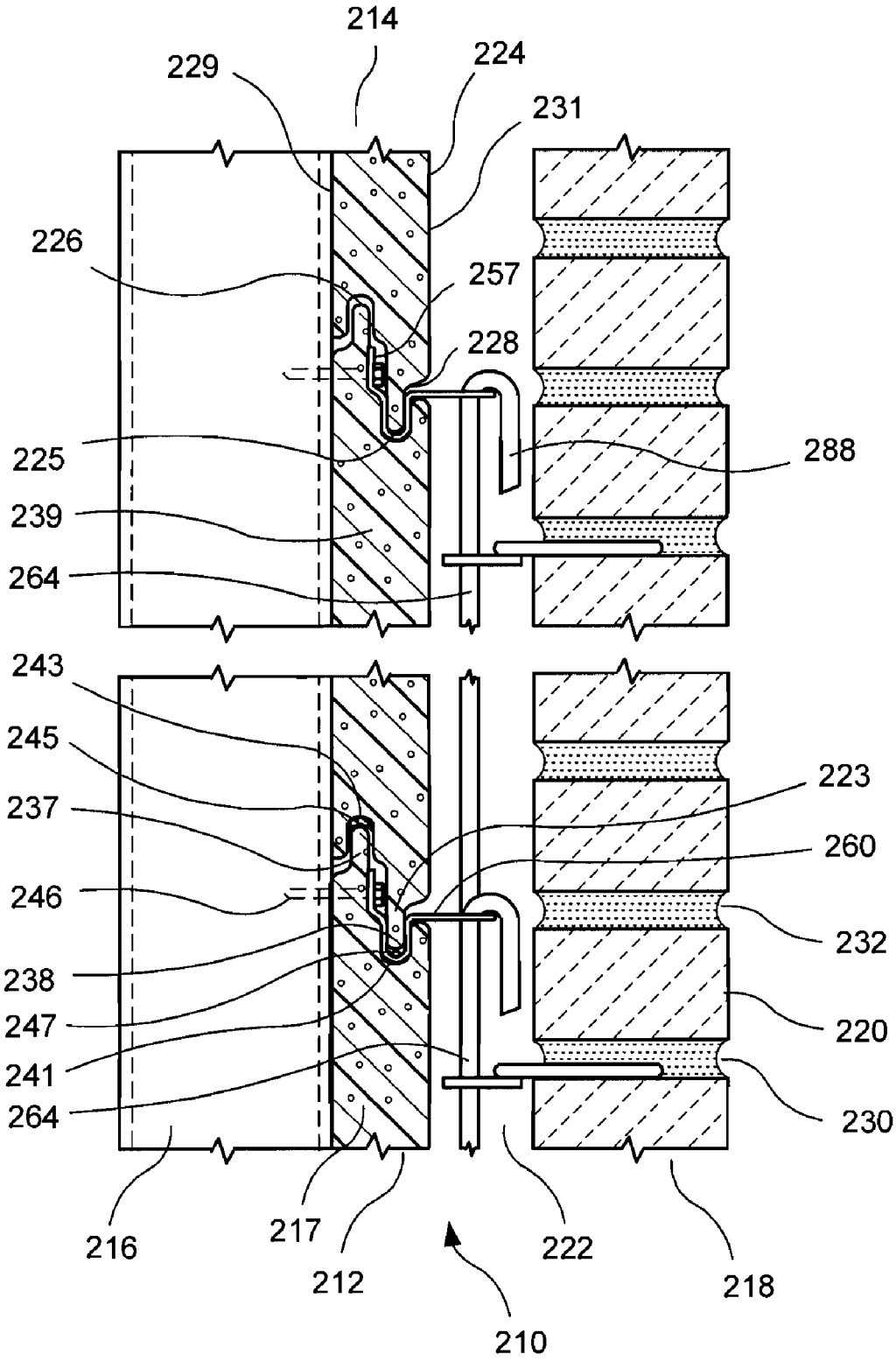
FIG. 10 is a cross sectional view of the third embodiment showing successive courses of a fully constructed composite panel anchoring system with a veneer tie threaded through the veneer anchor and mounted on a course of bricks.

The description which follows is a third embodiment of the surface-mounted anchoring system for cavity walls of this invention. For ease of comprehension, wherever possible, similar parts use reference designators 200 units higher than those above. Thus, the backup wall 214 of the third embodiment is analogous to the backup wall 14 of the first embodiment. Referring now to FIGS. 9 and 10, the third embodiment of the anchoring system for composite panels is shown and is referred to generally by numeral 210. As in the first embodiment, a cavity wall structure 212 is shown having an inner wythe or composite panel backup wall 214 supported on a structural framework or frame, including metal studs or vertical columns 216. The inner wythe 214 is assembled from individual panels 217 having adjacent panel ends forming a vertical joint (not shown) and being connected along the lower and upper edges 225, 226 to form a horizontal wall joint 228. The cavity wall 212 also includes an outer wythe or facing 218 of brick 220 construction. Between the inner wythe 214 and the outer wythe 218, a cavity 222 is formed.

Successive bed joints 230 and 232 are substantially planar and horizontally disposed and, in accord with building standards, are 0.375-inch (approx.) in height. Selective ones of bed joints 230 and 232, which are formed between courses of bricks 220, are constructed to receive therewithin the insertion portion of the veneer tie of the anchoring system hereof.

The composite panel 214 is typically between 12 and 20 feet long and approximately 24 to 36 inches wide, and comprises inner and outer facing sheets 229, 231 and a structural insulative core 239 of foam filling the interior space of the building panel 214 and adhesively connecting the facings sheets 229, 231 to provide a structural panel. Although the use of a foam is discussed herein, it is to be understood that this represents only one type of core material that are utilized in a composite building panel. Examples of other types of core material that are substituted for the foam core include polymeric materials and a conventional honeycomb core structure.

At the upper edge 226 of the composite panel 214, the inner and outer facings sheets 229, 231 provide inner and outer connectors or tongues 237, 238, at the edges of the panels, the inner and outer facing sheets 229, 231 provide inner and outer connectors or grooves 241, 243 adapted to receive the tongues 237, 238 of a subjacent building panel. The inner and outer connectors grooves 241, 243 each receive a bead 245, 247 of sealant, such as a non-hardening butyl sealant. The beads 245, 247 of sealant are adapted to be penetrated by the tongues 237, 238 of a subjacent panel to form inner and outer seals.

Gutter means 257 is provided at the upper edge 226 of the building panel 214 and intermediate of the inner and outer tongues 237, 238. The gutter means extends substantially entirely along the full length of the building panel 214. The gutter means serves to eliminate water and moisture bypassing the outer joint formed between the groove 241 and the tongue of 237 of a subjacent building panels.

The wall anchor 260 is shown as a shaped tabbed metal strip which is mounted between adjacent composite panels. The wall anchor 260 has a length that corresponds to the linear border. The wall anchor 260 is a metal stamping constructed from galvanized steel, hot dipped galvanized steel, stainless steel or bright basic steel. The wall anchor 260 is also mountable between horizontally adjacent composite panels (not shown). The wall anchor has a base portion 280, a contoured portion 282 and a plurality of free end portions 284 with one or more receptor portions 286. The base portion 280 is substantially planar and fastened to the frame 216. The contoured portion 282 of the wall anchor 260 is shaped to mirror the composite panel tongue and grooves 237, 239, 241 and 243 and to fit within the juncture 228 without obstructing the interengagement of the composite panels or the gutter means 257.

The anchor free end portions 284 extends through the seam 228 created at the junction of the adjacent composite panels. Upon installation, the free end portions 284 are disposed in the cavity 222 for interconnection with the veneer tie 268 through a receptor portion 266. The wall anchor 260 fits within the junction of the adjacent composite panels and is fastened to the column 216. The anchor 260 is fastened to the column 216 with a fastener 246 thereby creating a high-strength connection with the anchor 260 and the composite panel 214. Although other fastening means are compatible, the fastener 246 is typically a bolt with a head with a washer mounted under the bolt head. A thermal break is obtained through the use of a neoprene washer (not shown) between the fastener 246 and the composite panel 214. When a gypsum board with a membranous vapor permeable water barrier is part of the backup wall, an optional continuous shim (not shown), for protecting the dimensional stability of the membrane may be inserted adjacent the column.

Although various veneer ties work in conjunction with the wall anchor 260, including the use of a veneer tie 44 as shown in the first embodiment above or a box or Byna-Tie threadedly mounted through the free end aperture (not shown), the veneer tie 268 shown is a wire formative device that is disposed on a hooked shaped connection bar 264, which is threaded through the free end aperture 266 of the wall anchor 260.

The connection bar 264 is constructed of metal and has a receiving end 288 for disposition in the receptor 266 and a connection end 290 opposite the receiving end 288 for disposition in the cavity. The veneer tie 268 contains a veneer tie receptor 270 that is threaded through the connection bar 264 to the desired location at an appropriate level to be secured within the bed joint 232. The size and length of the connection bar 264 is consistent with the size of the panel 214 and hold several veneer ties 268 to allow for proper anchoring in accordance with individual building codes for adjustable vertical alignment with the bed joints 230, 232.

The anchor system of this embodiment includes the wall anchor 260, the connection bar 264 and a veneer tie 268. The veneer tie 268, shown in FIG. 10 as being emplaced on the course of bricks 220 in preparation for embedment in the mortar of the bed joint 230. The veneer tie 268 then fixedly disposed in an x-z plane of the bed joint 230 is constructed to adjustably position with the longitudinal axis substantially horizontal and to interengage with the wall anchor 260. The veneer tie 268 contains a rear leg 272, that is threaded through the veneer tie receptor 270, a pair of side legs 274 and a pair of front legs 276. The veneer tie 268 is disposed for interengagement with the connection bar 264, and, upon installation, maintains continuous positive interengagement with the wall anchor 260. The front legs 276 are optionally swaged to receive and accommodate a snap-in wire (not shown) for additional seismic protection.

The anchoring system for composite panels set forth above solves the problems of the prior art by providing a universal all-in-one solution to thermal transfer, pinpoint loading, high lateral forces and maintaining insulation integrity. The novel use of a composite panel backup wall with an integral veneer anchor saves material and labor costs while providing a superior cavity wall structure.

As is shown in the above embodiments, any number of veneer ties are utilized in conjunction with the present anchoring system. Additionally, any number of veneers are also utilized with the anchoring system, including but not limited to brick and masonry block. The wall anchor is fabricated to fit within the juncture of any composite panel system, without obstructing the interengagement of the panels or drainage assemblies providing a secure connection between the frame and the veneer. The anchor is formed during a stamping operation, cut from a plate like member or formed from any other metal working process.

Adjustments in the construction of the wall anchor to provide solutions to individual construction issues such as pinpoint loading, thermal transfer and lateral forces are recognized and anticipated. Further, the particular embodiments set forth above are in no way limiting of possible variations to accommodate changes in the construction of the inner or outer wythe. It is intended that the claims cover such modifications that do not alter the scope of the present invention. Because many varying and different embodiments may be made within the scope of the inventive concept herein taught and because many modifications may be made in the embodiments herein detailed in accordance with the descriptive requirement of the law, it is to be understood that the details herein are to be interpreted as illustrative and not in a limiting sense.

What is claimed is:

1. An anchoring system for use in a wall having a backup wall and a veneer in a spaced apart relationship with a cavity therebetween, said backup wall formed from a plurality of interengaged composite panels having a juncture between adjacent panels, said panels mounted on a frame, said anchoring system comprising:

a Z-shaped wall anchor configured for disposition within said juncture of said adjacent panels, said wall anchor, in turn, comprising:

a base portion having a planar body, a panel-housed portion attached to said base portion and adapted to be disposed in said backup wall, the panel housed portion having a free edge opposite a location where the panel housed portion is attached to the base portion, the panel housed portion being planar from the free edge toward the location of attachment to the base portion, one or more free end portions attached to said base portion opposite the panel-housed portion and oriented at a non-zero angle with respect to the base portion and adapted to extend into said cavity, each of said one or more free end portions having a planar body, each of said one or more free end portions further comprising:

a receptor portion disposed therein and configured for receiving a veneer tie; and, a fastener configured for mounting said base portion of said wall anchor to said frame.

2. An anchoring system as described in claim 1, wherein said veneer is formed from a plurality of successive courses of bricks with a bed joint between adjacent courses, wherein said anchoring system further comprises:

a veneer tie having an interengaging end for disposition in said receptor portion and an insertion end configured for embedment in said bed joint of said veneer.

3. An anchoring system as described in claim 2, wherein said veneer tie further comprises:

front leg portions configured for insertion into said bed joint of said veneer;

side leg portions coextensive, perpendicular, and substantially co-planar with said front leg portions; and, a pair of pintle portions coextensive with said pair of side leg portions and upon installation configured to be vertically disposed for insertion through said receptor portion, said veneer tie being vertically adjustable to a substantially horizontal position.

4. An anchoring system as described in claim 2, wherein said veneer tie is a wire formative and further comprises:

a receiving end for threading through said receptor portion of each of said one or more free end portions;

an insertion end contiguous with and opposite said receiving end, said insertion end being swaged for interconnection with a reinforcement wire adapted to be disposed in said bed joint;

whereby, upon installation of said anchoring system with an interconnected reinforcement wire in said veneer, said system provides a high degree of seismic protection.

5. An anchoring system as described in claim 2, wherein said anchoring system further comprises:

a connection bar having a receiving end for disposition in said receptor portion and a connection end opposite said receiving end for disposition in said cavity; and wherein the veneer tie has an apertured end for disposition on said connection bar and an insertion end configured for embedment in said bed joint of said veneer;

whereby said veneer tie is horizontally disposed and adjustable for vertical alignment with said bed joint.

6. An anchoring system as described in claim 1, wherein said wall anchor is a metal stamping constructed of material selected from a group consisting of galvanized steel, hot dip galvanized steel, stainless steel, and bright basic steel.

7. An anchoring system as described in claim 1, wherein said frame is a metal column, and wherein said fastener comprises:

a bolt having a head; and an insulative washer for mounting under said head of said bolt;

whereby said fastener is adapted to secure said anchor to said composite panel and said frame and minimizes thermal transfer between said frame and said anchoring system.

8. An anchoring system as described in claim 1, wherein said panel-housed portion is contiguous with said base portion and further comprises prongs disposed opposite said base portion, whereby upon insertion of said prongs into said composite panels said prongs are adapted to secure said wall anchor to said backup wall, providing a gauge for positioning said receptor portion, and minimizing thermal transfer.

9. An anchoring system as described in claim 1, wherein said panel-housed portion is contiguous with each of said one or more free end portions and said base portion.

10. An anchoring system as described in claim 1, wherein the wall anchor comprises a plurality of free end portions contiguous with said base portion and disposed opposite said panel-housed portion at spaced intervals, each free end portion being adapted to extend into said cavity and comprising a receptor portion disposed therein.

11. An anchoring system for use in a wall having a backup wall and a veneer in a spaced apart relationship with a cavity therebetween, said backup wall formed from a plurality of interengaged composite panels having a juncture between adjacent panels, said panels mounted on a frame, said anchoring system comprising:

a Z-shaped wall anchor configured for disposition within said juncture of said adjacent panels, said wall anchor, in turn, comprising:

a base portion having a planar body, a panel-housed portion attached to and contiguous with said base portion and adapted to be disposed in said backup wall, the panel housed portion having a free edge opposite a location where the panel housed portion is attached to the base portion, the panel housed portion being planar from the free edge toward the location of attachment to the base portion, said panel-housed portion further comprising:

prongs disposed opposite said base portion and secured within said composite panel;

one or more free end portions attached to and contiguous with said base portion and oriented at a non-zero angle with respect to the base portion, each of said one or more free end portions disposed opposite said panel-housed portion, each of said one or more free end portions having a planar body and being adapted to extend into said cavity, each of said one or more free end portions further comprising:

a receptor portion disposed therein and configured for receiving a veneer tie; and, a fastener configured for mounting said base portion of said wall anchor to said frame.

12. An anchoring system as described in claim 11, wherein said veneer is formed from a plurality of successive courses of bricks with a bed joint between adjacent courses, wherein said anchoring system further comprises:

a veneer tie having an interengaging end for disposition in said receptor portion and an insertion end configured for embedment in said bed joint of said veneer.

13. An anchoring system as described in claim 11, wherein said wall anchor is a metal stamping constructed of material selected from a group consisting of galvanized steel, hot dip galvanized steel, stainless steel, and bright basic steel.

14. An anchoring system as described in claim 11, wherein said frame is a metal column, and wherein said fastener comprises:

a bolt having a head; and an insulative washer for mounting under said head of said bolt;

whereby said fastener is adapted to secure said anchor to said composite panel and said frame and minimizes thermal transfer between said frame and said anchoring system.

* * * * *